US008385786B2

(12) United States Patent
Kawasaki

(10) Patent No.: US 8,385,786 B2
(45) Date of Patent: Feb. 26, 2013

(54) DEVELOPING APPARATUS AND IMAGE FORMING APPARATUS

(75) Inventor: Tomohiro Kawasaki, Sagamihara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 409 days.

(21) Appl. No.: 12/725,622

(22) Filed: Mar. 17, 2010

(65) Prior Publication Data

US 2010/0239273 A1 Sep. 23, 2010

(30) Foreign Application Priority Data

Mar. 19, 2009 (JP) ..... 2009-067829

(51) Int. Cl.
*G03G 15/08* (2006.01)

(52) U.S. Cl. ..... 399/256; 399/27; 399/257; 399/258

(58) Field of Classification Search ..... 399/256, 399/254, 257, 258, 27
See application file for complete search history.

(56) References Cited

U.S. PATENT DOCUMENTS

| | | | | |
|---|---|---|---|---|
| 6,125,243 | A * | 9/2000 | Shoji et al. | 399/257 X |
| 2008/0124132 | A1* | 5/2008 | Aimoto | 399/256 |
| 2009/0214267 | A1* | 8/2009 | Uno | 399/257 |

FOREIGN PATENT DOCUMENTS

| | | | |
|---|---|---|---|
| JE | 2002-148927 | A | 5/2002 |
| JP | 2001-265102 | A | 9/2001 |
| JP | 2003-084555 | | 3/2003 |
| JP | 2006-276071 | | 10/2006 |
| JP | 2008-015250 | | 1/2008 |
| JP | 2008-250290 | A | 10/2008 |

OTHER PUBLICATIONS

Office Action (Notification of Reason for Refusal) dated Nov. 30, 2010, issued in the corresponding Japanese Patent Application No. 2009-067829, and an English Translation thereof.

* cited by examiner

*Primary Examiner* — Sophia S Chen
(74) *Attorney, Agent, or Firm* — Buchanan Ingersoll & Rooney PC

(57) ABSTRACT

A developer accommodating container is provided with a first accommodating portion in which a first feeding member is arranged, a second accommodating portion in which a second feeding member is arranged, a first communication portion communicating the first accommodating portion and the second accommodating portion in their one end sides, a second communication portion and a third communication portion communicating the first accommodating portion and the second accommodating portion at two positions in the other end sides so as to be shifted their positions in a feeding direction of the developer, a discharge portion arranged between the second communication portion and the third communication portion in the second accommodating portion, and provided for discharging the developer, and a replenishing portion arranged in a downstream side in the feeding direction of the developer than the third communication portion in the first accommodating portion, and provided for replenishing the developer.

19 Claims, 10 Drawing Sheets

Fig. 8

| | | DETECTED TONER DENSITY (DETECTED VALUE IN STATE 1) | | | | | | |
|---|---|---|---|---|---|---|---|---|
| | | 5 | 5.5 | 6 | 6.5 | 7 | 7.5 | 8 |
| AMPLITUDE OF DETECTED WAVE FORM (DETECTED VALUE IN STATES 1 AND 2: V) | 3 | APPROPRIATE | WEIGHT SMALL 1 | WEIGHT SMALL 1 | WEIGHT SMALL 2 | WEIGHT SMALL 2 | WEIGHT SMALL 2 | WEIGHT SMALL 2 |
| | 2.8 | APPROPRIATE | WEIGHT SMALL 1 | WEIGHT SMALL 1 | WEIGHT SMALL 2 | WEIGHT SMALL 2 | WEIGHT SMALL 2 | WEIGHT SMALL 2 |
| | 2.6 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| | 2.4 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| | 2.2 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| | 2 | APPROPRIATE | APPROPRIATE | WEIGHT SMALL 1 | WEIGHT SMALL 1 | WEIGHT SMALL 2 | WEIGHT SMALL 2 | WEIGHT SMALL 2 |
| | 1.8 | APPROPRIATE | APPROPRIATE | WEIGHT SMALL 1 | WEIGHT SMALL 1 | WEIGHT SMALL 1 | WEIGHT SMALL 2 | WEIGHT SMALL 2 |
| | 1.6 | WEIGHT LARGE 1 | APPROPRIATE | APPROPRIATE | WEIGHT SMALL 1 | WEIGHT SMALL 1 | WEIGHT SMALL 1 | WEIGHT SMALL 2 |
| | 1.4 | WEIGHT LARGE 1 | APPROPRIATE | APPROPRIATE | APPROPRIATE | WEIGHT SMALL 1 | WEIGHT SMALL 1 | WEIGHT SMALL 1 |
| | 1.2 | WEIGHT LARGE 1 | WEIGHT LARGE 1 | APPROPRIATE | APPROPRIATE | WEIGHT SMALL 1 | WEIGHT SMALL 1 | WEIGHT SMALL 1 |
| | 1 | WEIGHT LARGE 1 | WEIGHT LARGE 1 | APPROPRIATE | APPROPRIATE | APPROPRIATE | WEIGHT SMALL 1 | WEIGHT SMALL 1 |
| | 0.8 | WEIGHT LARGE 1 | WEIGHT LARGE 1 | WEIGHT LARGE 1 | APPROPRIATE | APPROPRIATE | APPROPRIATE | WEIGHT SMALL 1 |
| | 0.6 | WEIGHT LARGE 2 | WEIGHT LARGE 1 | WEIGHT LARGE 1 | WEIGHT LARGE 1 | APPROPRIATE | APPROPRIATE | APPROPRIATE |
| | 0.4 | WEIGHT LARGE 2 | WEIGHT LARGE 2 | WEIGHT LARGE 1 | WEIGHT LARGE 1 | WEIGHT LARGE 1 | APPROPRIATE | APPROPRIATE |
| | 0.2 | WEIGHT LARGE 2 | WEIGHT LARGE 2 | WEIGHT LARGE 2 | WEIGHT LARGE 1 | WEIGHT LARGE 1 | WEIGHT LARGE 1 | WEIGHT LARGE 1 |

Fig. 10

| | | DETECTED TONER DENSITY (DETECTED VALUE IN STATE 1: wt %) | | | | | | |
|---|---|---|---|---|---|---|---|---|
| | | 5 | 5.5 | 6 | 6.5 | 7 | 7.5 | 8 |
| DETECTED WAVE FORM CYCLE FLUCTUATION RATIO | -2 | WEIGHT SMALL 2 | WEIGHT SMALL 2 | WEIGHT SMALL 2 | WEIGHT SMALL 2 | WEIGHT SMALL 2 | WEIGHT SMALL 2 | WEIGHT SMALL 2 |
| | -1.8 | WEIGHT SMALL 2 | WEIGHT SMALL 2 | WEIGHT SMALL 2 | WEIGHT SMALL 2 | WEIGHT SMALL 2 | WEIGHT SMALL 2 | WEIGHT SMALL 2 |
| | -1.6 | WEIGHT SMALL 2 | WEIGHT SMALL 2 | WEIGHT SMALL 2 | WEIGHT SMALL 2 | WEIGHT SMALL 2 | WEIGHT SMALL 1 | WEIGHT SMALL 1 |
| | -1.4 | WEIGHT SMALL 2 | WEIGHT SMALL 2 | WEIGHT SMALL 2 | WEIGHT SMALL 1 | WEIGHT SMALL 1 | WEIGHT SMALL 1 | WEIGHT SMALL 1 |
| | -1.2 | WEIGHT SMALL 2 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -1 | WEIGHT SMALL 1 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -0.8 | WEIGHT SMALL 1 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -0.6 | WEIGHT SMALL 1 | WEIGHT SMALL 1 | WEIGHT SMALL 1 | WEIGHT SMALL 1 | WEIGHT SMALL 1 | APPROPRIATE | APPROPRIATE |
| | -0.4 | WEIGHT SMALL 1 | WEIGHT SMALL 1 | WEIGHT SMALL 1 | APPROPRIATE | APPROPRIATE | APPROPRIATE | APPROPRIATE |
| | -0.2 | WEIGHT SMALL 1 | APPROPRIATE | APPROPRIATE | APPROPRIATE | APPROPRIATE | APPROPRIATE | APPROPRIATE |
| | 0 | APPROPRIATE | APPROPRIATE | APPROPRIATE | APPROPRIATE | APPROPRIATE | APPROPRIATE | APPROPRIATE |
| | 0.2 | APPROPRIATE | APPROPRIATE | APPROPRIATE | APPROPRIATE | APPROPRIATE | APPROPRIATE | APPROPRIATE |
| | 0.4 | APPROPRIATE | APPROPRIATE | APPROPRIATE | APPROPRIATE | APPROPRIATE | APPROPRIATE | WEIGHT LARGE 1 |
| | 0.6 | APPROPRIATE | APPROPRIATE | APPROPRIATE | APPROPRIATE | WEIGHT LARGE 1 | WEIGHT LARGE 1 | WEIGHT LARGE 1 |
| | 0.8 | APPROPRIATE | APPROPRIATE | WEIGHT LARGE 1 | WEIGHT LARGE 1 | WEIGHT LARGE 1 | WEIGHT LARGE 1 | WEIGHT LARGE 1 |
| | 1 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 1 |
| | 1.2 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 1 |
| | 1.4 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 2 |
| | 1.6 | WEIGHT LARGE 1 | WEIGHT LARGE 1 | WEIGHT LARGE 1 | WEIGHT LARGE 1 | WEIGHT LARGE 2 | WEIGHT LARGE 2 | WEIGHT LARGE 2 |
| | 1.8 | WEIGHT LARGE 1 | WEIGHT LARGE 1 | WEIGHT LARGE 2 | WEIGHT LARGE 2 | WEIGHT LARGE 2 | WEIGHT LARGE 2 | WEIGHT LARGE 2 |
| | 2 | WEIGHT LARGE 2 | WEIGHT LARGE 2 | WEIGHT LARGE 2 | WEIGHT LARGE 2 | WEIGHT LARGE 2 | WEIGHT LARGE 2 | WEIGHT LARGE 2 |

Fig. 11

| PRESSURE SENSOR OUTPUT (V) | |
|---|---|
| 1.15 | WEIGHT SMALL 2 |
| 1.3 | WEIGHT SMALL 2 |
| 1.45 | WEIGHT SMALL 2 |
| 1.6 | WEIGHT SMALL 1 |
| 1.75 | WEIGHT SMALL 1 |
| 1.9 | WEIGHT SMALL 1 |
| 2.05 | WEIGHT SMALL 1 |
| 2.2 | WEIGHT SMALL 1 |
| 2.35 | APPROPRIATE |
| 2.5 | APPROPRIATE |
| 2.65 | APPROPRIATE |
| 2.8 | APPROPRIATE |
| 2.95 | APPROPRIATE |
| 3.1 | APPROPRIATE |
| 3.25 | WEIGHT LARGE 1 |
| 3.4 | WEIGHT LARGE 1 |
| 3.55 | WEIGHT LARGE 1 |
| 3.7 | WEIGHT LARGE 1 |
| 3.85 | WEIGHT LARGE 1 |
| 4 | WEIGHT LARGE 2 |
| 4.15 | WEIGHT LARGE 2 |

DEVELOPING APPARATUS AND IMAGE FORMING APPARATUS

This application is based on Japanese Patent Application No. 2009-067829 filed in Japan on Mar. 19, 2009, the entire content of which is hereby incorporated by reference.

BACKGROUND OF THE INVENTION

1. Field of the Invention

The present invention relates to a DEVELOPING APPARATUS and an image forming apparatus.

2. Description of the Related Art

Conventionally, in a so-called trickle type image forming apparatus structured such as to discharge a developer including a deteriorated carrier, and replenish a new developer, for example, the following structure is known.

In other words, in Japanese Unexamined Patent Publication No. 2008-250290, there is disclosed a structure which is provided with an inflow portion making a developer flow from a first accommodating chamber to a second accommodating chamber. The inflow portion is constructed by opening portions (a first opening portion and a second opening portion) at two positions. The first opening portion is arranged in the vicinity of an upstream side of an inverse winding blade of a first feeding member provided in the first accommodating chamber, and the second opening portion is formed in a downstream side thereof. Further, a discharge portion for discharging the developer is formed in the middle of the inverse winding blade, and a replenishing portion for replenishing the developer is formed within the first accommodating chamber in the vicinity of the downstream side thereof.

SUMMARY OF THE INVENTION

However, in the DEVELOPING APPARATUS described in the Japanese Unexamined Patent Publication No. 2008-250290 mentioned above, the replenishing portion of the developer is arranged within the first accommodating chamber, and is positioned in the vicinity of the discharge portion. Accordingly, if an amount of the replenished developer is much, there is a problem that the developer is discharged from the discharge portion in spite that it is not deteriorated. Further, since the discharge portion is provided in a region in which the inverse winding blade is arranged, that is, a region in which the developer is apt to stay, there is the danger that the developer is discharged from the discharge portion more than necessary.

Accordingly, an object of the present invention is to provide a DEVELOPING APPARATUS and an image forming apparatus which can prevent a developer from being discharged more than necessary, and can maintain an amount of the developer in an inner portion at an appropriate value so as to obtain a desired toner density.

The present invention adopts a following configuration as means to solve above described problem:

a DEVELOPING APPARATUS including:

a developer carrying member;

a developer accommodating container extending from one end to the other end along the developer carrying member, and in which the developer is accommodated;

a first feeding member provided within the developer accommodating container and feeding the accommodated developer while agitating; and a second feeding member provided within the developer accommodating container and feeding the developer to the developer carrying member, wherein the developer accommodating container includes:

a first accommodating portion in which the first feeding member is arranged;

a second accommodating portion in which the second feeding member is arranged;

a first communication portion communicating the first accommodating portion and the second accommodating portion in one end side;

a second communication portion and a third communication portion communicating the first accommodating portion and the second accommodating portion at two positions in the other end side so as to be shifted their positions in a feeding direction of the developer;

a discharge portion arranged between the second communication portion and the third communication portion in the second accommodating portion, and provided for discharging the developer; and a replenishing portion arranged in a downstream side in the feeding direction of the developer than the third communication portion, in the first accommodating portion, and provided for replenishing the developer.

In accordance with this structure, the developer is fed to the second communication portion side and the third communication portion side by the second feeding member in the second accommodating portion. The developer fed to the third communication portion side is partly discharged via the discharge portion, and thereafter flows to the first accommodating portion via the third communication portion. In the first accommodating portion, the new developer is replenished via the replenishing portion, and is mixed with the developer flowing via the third communication portion so as to be fed. As mentioned above, since the replenishing portion is provided in the first accommodating portion side in place of the second accommodating portion provided with the discharge portion, the replenished developer is not discharged from the discharge portion. Accordingly, it is possible to appropriately regulate the toner density within the developer accommodating container.

It is preferable that the replenishing portion is arranged between the second communication portion and the third communication portion.

In accordance with this structure, the new developer replenished via the replenishing portion is first of all mixed with the remainder of the developer which is discharged by the discharge portion so as to be reduced. Therefore, it is possible to smoothly replenish the developer from the replenishing portion. Further, the remainder of the developer and the newly replenished developer are mixed with the developer which circulates via the second communication portion. Accordingly, a fluctuation of the toner density of the developer is small, and it is possible to obtain a good condition all over a whole of the developer accommodating container.

It is preferable that a conveyance inhibiting portion preventing the conveyance of the developer is provided in the vicinity of an upstream side in a feeding direction of the developer, with respect to the discharge portion.

In accordance with this structure, only the surplus developer running over the conveyance inhibiting portion is fed to the discharge portion. In the discharge portion, after a part of the developer is discharged, the remainder is fed as it is so as to flow to the first accommodating portion via the third communication portion. Accordingly, it is possible to prevent such a problem that the discharging amount in the discharge portion becomes more than necessary from being generated.

It is preferable that an opening degree regulating member for regulating an opening degree of the discharge portion is provided.

In accordance with this structure, in the case that it is not necessary to discharge the developer, it is possible to make the opening degree of the discharge portion small by the opening degree regulating member, or close the discharge portion. The developer passing through the discharge portion flows to the first accommodating portion via the third communication portion, and flows together with the developer circulating via the second communication portion so as to keep up with the circulating movement. Therefore, since it is possible to feed the developer in all the regions within the developer accommodating container, the developer does not stay. Accordingly, it is possible to prevent such a problem that the feeding member is exposed to an unreasonable load so as to be damaged from being generated.

It is preferable that a developer weight presuming member for presuming a weight of the developer within the developer accommodating container; and an opening degree controller regulating an opening degree of the discharge portion by controlling to drive the opening degree regulating member on the basis of the weight of the developer which is presumed by the developer weight presuming member are further provided.

In accordance with this structure, it is possible to set the weight of the developer discharged via the discharge portion to an appropriate value on the basis of the weight of the developer within the developer accommodating container.

Further, in accordance with the present invention, there is provided an image forming apparatus which is provided with the DEVELOPING APPARATUS described in any one of the aspects mentioned above, as a means for solving the problem mentioned above.

In accordance with the present invention, since the discharge portion is provided at the position within the second accommodating portion running over the second communication portion, and the replenishing portion is provided at the position within the first accommodating portion running over the third communication portion, it is possible to prevent such a problem that the developer replenished from the replenishing portion is directly discharged from the discharge portion from being generated. Therefore, it is possible to appropriately regulate the toner density within the developer accommodating container.

BRIEF DESCRIPTION OF THE DRAWINGS

FIG. 8 is a data table for presuming a weight of a developer within a developer accommodating container on the basis of an amplitude of a signal wave form detected by the toner density sensor and the toner density;

FIG. 10 is a data table for presuming the weight of the developer within the developer accommodating container on the basis of a fluctuation ratio of the signal wave form detected by the toner density sensor and the toner density; and FIG. 11 is a data table for presuming the weight of the developer within the developer accommodating container on the basis of a result of detection by a pressure sensor.

DETAILED DESCRIPTION OF THE PREFERRED EMBODIMENTS

A description will be given below of an embodiment in accordance with the present invention with reference to the accompanying drawings. In this case, in the following description, terms (for example, terms including "upper", "lower", "side" and "end") indicating specific directions and positions are used as occasion demands, however, these terms are used for facilitating the understanding of the invention with reference to the drawings, and a technical range of the present invention is not limited by the meanings of the terms.

1. Whole Construction

Figure 1:
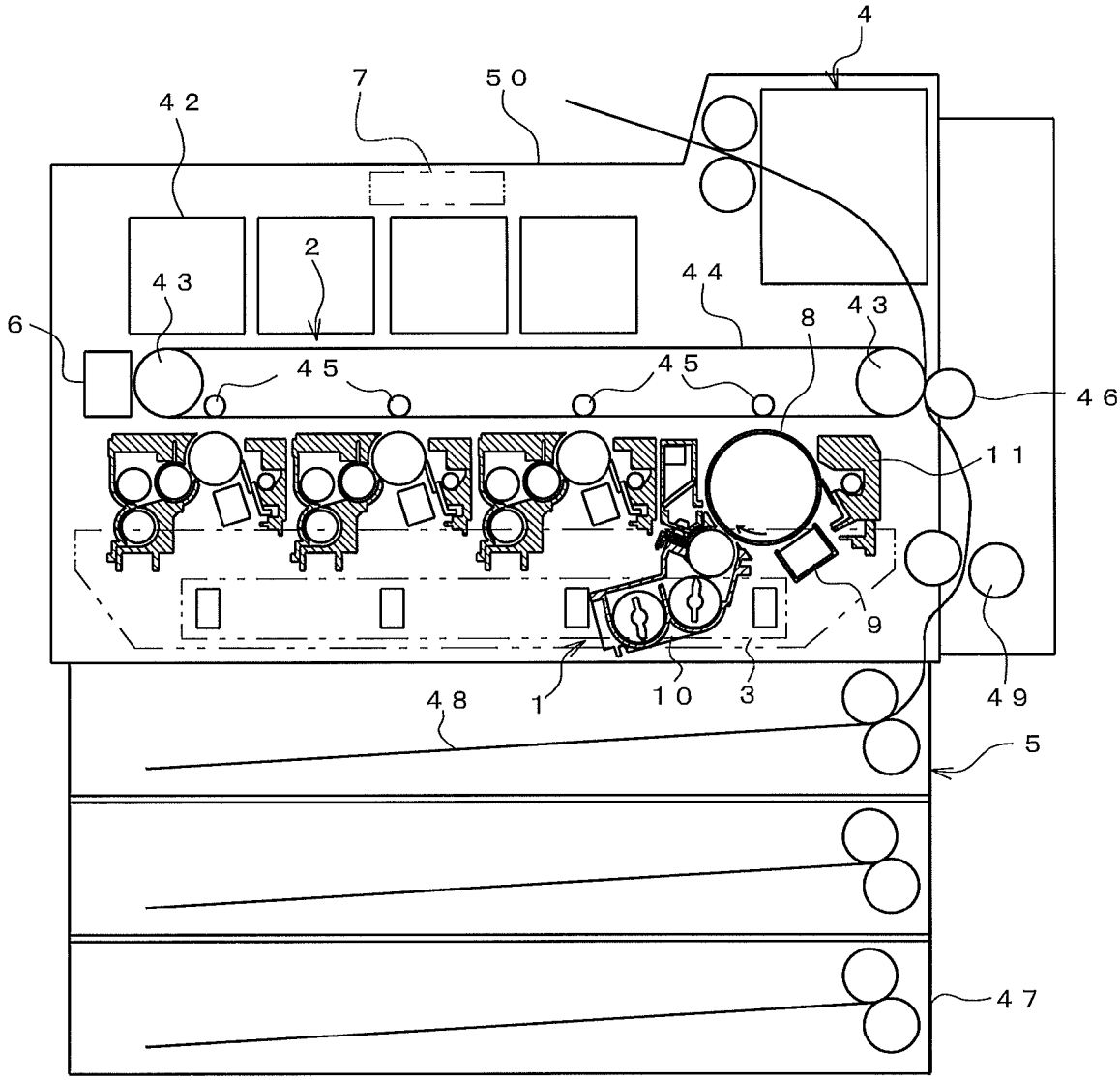
FIG. 1 is a front elevational view showing an outline of an image forming apparatus in accordance with the present embodiment.

FIG. 1 shows a so-called trickle type image forming apparatus, particularly structured such as to replenish a developer in addition to a toner, in an electronic photography system using a two-component developer. The image forming apparatus is generally provided with an image forming unit 1, a transfer unit 2, an exposure unit 3, a fixing unit 4, a paper feeding unit 5, a cleaning unit 6, a controller 7 (refer to FIG. 4) and the like. In this case, the image forming apparatus may be constructed by any of a copy machine, a printer, a facsimile, and a complex machine complexly provided with these functions.

(1-1. Image Forming Unit 1)

The image forming units 1 are arranged at four positions along an intermediate transfer belt 44 of the transfer unit 2, and form a color image on a surface of the intermediate transfer belt 44 by respectively carrying out an image formation of yellow (Y), magenta (M), cyan (C) and black (Bk) from a left side. Each of the image forming units 1 is provided with a charging apparatus 9, a DEVELOPING APPARATUS 10, a cleaning apparatus 11 and the like around a photoreceptor drum 8, as shown in FIG. 2.

The charging apparatus 9 forms a predetermined surface potential on a surface of the photoreceptor drum 8. The surface potential comes to an electrostatic latent image by being exposed by the exposure unit 3. In this case, a non-contact type scorotron charger is used as the charging apparatus 9, however, it is possible to use, for example, a contact type such as a blade-shaped, a brush-shaped, and the like, and it is possible to use a charging roller.

Figure 2:
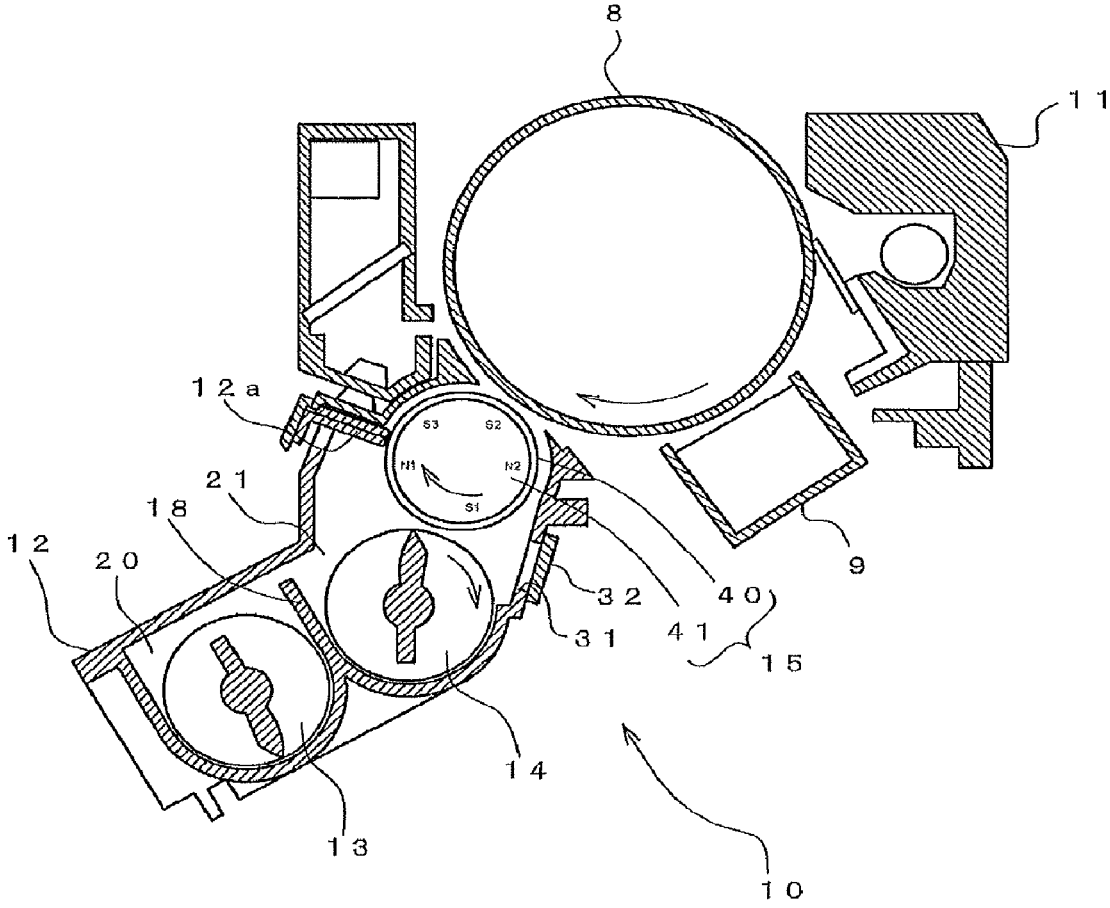
FIG. 2 is a front cross sectional view showing an outline of an image forming unit in FIG. 1.
Figure 3:
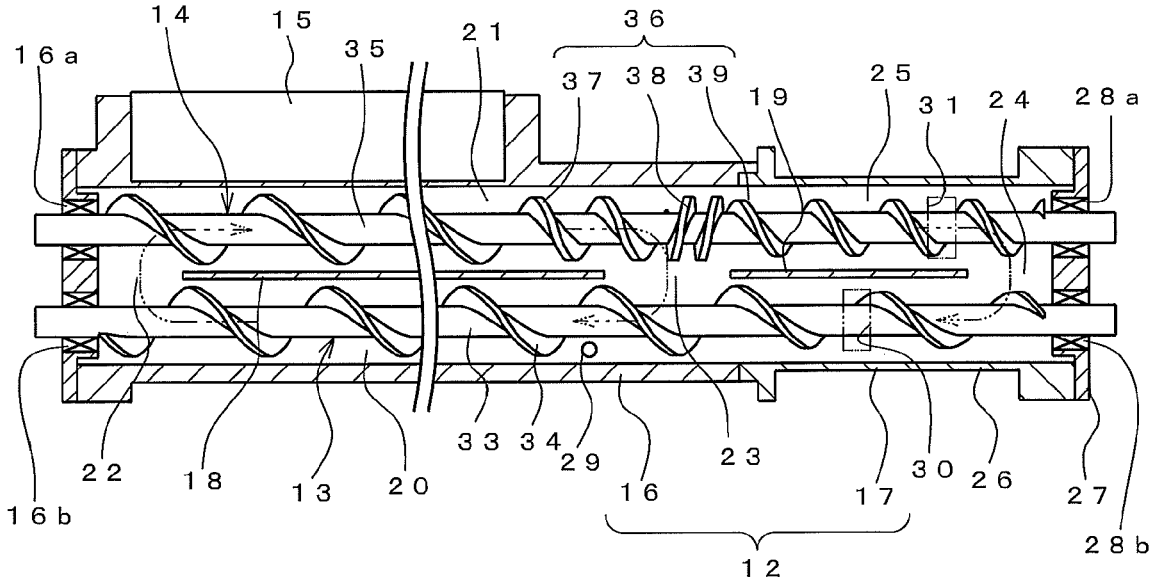
FIG. 3 is a plan cross sectional view showing an outline of a DEVELOPING APPARATUS in FIG. 2.

The DEVELOPING APPARATUS 10 is structured, as shown in FIGS. 2 and 3, such that each of an agitating screw 13, a feeding screw 14 and a developing roller 15 serving as a developer carrier is accommodated within a developer accommodating container 12.

The developer accommodating container 12 is formed as a long box shape extending from one end side to the other end side, as shown in FIG. 3, and is constructed by a main body portion 16, and a tubular portion 17 installed to one end side opening portion thereof. An inner side of the developer accommodating container 12 is divided into two sections including a first accommodating portion 20 and a second accommodating portion 21 by a first partition wall 18 formed within the main body portion 16, and a second partition wall 19 formed within the tubular portion 17. The second accommodating portion 21 is positioned diagonally above the first accommodating portion 20. The first accommodating portion 20 and the second accommodating portion 21 are communicated in their one end sides by a first communication portion 22 formed in the first partition wall 18. Further, the first accommodating portion 20 and the second accommodating portion 21 are communicated at their other end sides by a second communication portion 23 formed between the first partition wall 18 and the second partition wall 19, and a third communication portion 24 formed in the second partition wall 19, respectively. An inflow regulation region 25 of a developer is formed in the other end side of the second accommodating portion 21 by the second partition wall 19. The tubular portion 17 is constructed by a tubular main body 26 and a lid body 27. Bearing portions 28*a* and 28*b* are formed respectively at two positions in the lid body 27, and one end portions of the agitating screw 13 and the feeding screw 14 are rotatably supported.

The first accommodating portion 20 is provided with a toner density sensor 29 as a means for detecting a toner amount per unit volume. The toner density sensor 29 is a conventionally well-known sensor which outputs a difference of magnetic permeability of the developer (an iron content included in a carrier) as a frequency, and computes a toner density (a weight rate of the toner with respect to the developer).

Further, a developer replenishing port 30 is formed between the second communication portion 23 and the third communication portion 24, in a part (a portion constructed by the tubular portion 17) of the first accommodating portion 20. Further, the structure is made such that a new developer is appropriately replenished from a developer replenishing container 42 via the developer replenishing port 30.

A developer discharge port 31 is formed between the second communication portion 23 and the third communication portion 24, as shown in FIG. 2, in a part (a portion constructed by the tubular portion 17) of the second accommodating portion 21. The developer discharge port 31 is opened and closed by an opening degree regulating plate 32, and discharges the developer by appropriately opening so as to prevent the deteriorated carrier from staying within the developer accommodating container 12 over a long period.

The agitating screw 13 is structured, as shown in FIG. 3, such that a spiral agitating blade 34 is provided around an agitating side rotating shaft 33, and is arranged within the first accommodating portion 20. The agitating screw 13 is structured such that both end portions of the agitating side rotating shaft 33 are rotatably supported respectively to both end walls (a bearing portion 16*b* of one end wall of the main body portion 16 and a bearing portion 28*b* of the lid body 27) constructing the first accommodating portion 20. If the agitating screw 13 rotates, the developer is fed from the second communication portion 23 side to the first communication portion 22 side by the agitating blade 34 while agitating. In this case, an agitating paddle (not shown) may be appropriately formed in an outer peripheral surface of the agitating side rotating shaft 33, thereby forcibly moving the developer from the first accommodating portion 20 to the second accommodating portion 21 via the first communication portion 22.

The feeding screw 14 is structured, as shown in FIG. 3, such that a spiral feeding blade 36 is provided around a feeding side rotating shaft 35. Both end portions of the feeding side rotating shaft 35 are rotatably supported to both end walls (a bearing portion 16*a* of one end wall of the main body portion and a bearing portion 28*a* of the lid body 27) constructing the second accommodating portion 21. Further, the feeding blade 36 is constructed by a first blade portion 37, a second blade portion 38 and a third blade portion 39. The first blade portion 37 is formed in such a manner as to be capable of feeding the developer within the second accommodating portion 21 from the first communication portion 22 side to the second communication portion 23 side while agitating, on the basis of a rotation of the feeding side rotating shaft 35, and feeds the developer to the developing roller 15 in the feeding process thereof. The second blade portion 38 is wound inversely to the first blade portion 37, is formed in the vicinity of the second communication portion 23, and regulates an inflow of the developer into the inflow regulation region 25. In other words, the second blade portion 38 applies a certain resistance force to the developer heading for the developer discharge port 31 side. Accordingly, only the surplus developer is discharged from the developer discharge port 31. The second blade portion 38 is formed in such a manner that an outer diameter thereof is smaller in comparison with the first blade portion 37 and a slope with respect to a plane which is perpendicular to the feeding side rotating shaft 35 is held down, whereby an angle with respect to a contact surface of a flow path limiting portion becomes small. The third blade portion 39 has the same winding direction as the first blade portion 37, and has such a small diameter as to be arranged within the flow path limiting portion. In this case, a feeding paddle (not shown) may be formed appropriately in an outer peripheral surface of the feeding side rotating shaft 35 so as to forcibly move the developer from the second accommodating portion 21 to the first accommodating portion 20 via the second communication portion 23 or the third communication portion 24.

The developing roller 15 is structured, as shown in FIG. 2, such that a plurality of permanent magnets 41 are accommodated within a cylindrical sleeve 40 (in this case, five permanent magnets S2, N2, S1, N1 and S3 are arranged in a clockwise direction in this order). The sleeve 40 is structured such as to rotate in a direction of an arrow in the drawing by a sleeve driving member (not shown).

A developer replenishing container 42 replenishing a replenishing two-component developer (hereinafter, described simply as a developer) constructed by a toner and a carrier is detachably provided, as shown in FIG. 1, above the DEVELOPING APPARATUS 10. The developer replenished from the developer replenishing container 42 is structured such as to flow into the first accommodating portion 20 via the developer replenishing port 30 formed in the developer accommodating container 12. In this case, a toner density of the developer which is previously accommodated in the developer accommodating container 12 is 7%, and a toner density of the developer which is replenished from the developer replenishing container 42 is 80% (a carrier density is 20%, and generally between 10 and 20%).

The cleaning apparatus 11 recovers the toner staying in the surface of the photoreceptor drum 8 after being transferred to the surface so as to clean, as shown in FIG. 1. In this case, a plate-like blade is used as the cleaning apparatus 11, and one end side thereof comes into contact with an outer peripheral surface of a photoreceptor. In this case, the cleaning apparatus 11 is not limited to the blade, but can use the other cleaning members (for example, a fixed brush, a rotating brush, a roller). Further, it is possible to use a plurality of cleaning apparatuses 11 in conjunction, and it is possible to employ a cleaner less system recovering the un-transferred toner by the DEVELOPING APPARATUS 10 in place of the cleaning apparatus 11.

(1-2. Transfer Unit 2)

The transfer unit 2 is structured, as shown in FIG. 1, such that an intermediate transfer belt 44 is bridged over a pair of support rollers 43, the support rollers 43 are driven by a driving member (not shown), and the intermediate transfer belt 44 is moved in a circulating manner in a direction of an arrow, and is provided with a primary transfer portion 45 and a secondary transfer portion 46.

(1-3. Exposure Unit 3)

The exposure unit 3 irradiates a laser light to the photoreceptor drum 8, as shown in FIG. 1, and forms an electrostatic latent image corresponding to an image data read by a scanner (not shown). It is possible to use, for example, a laser or a light emitting diode or the like, as the exposure unit 3.

(1-4. Fixing Unit 4)

The fixing unit 4 is structured such as to rotatably support a fixing roller and a pressurizing roller, although not being illustrated. The fixing roller is made of a conductive material, is rotatably driven by a motor (not shown), and is induction heated by an exciting coil (not shown). The pressurizing roller is brought into pressure contact with the fixing roller, and pinches a recording medium 48. Accordingly, it is possible to fix the toner transferred by the transfer unit 2 to the recording medium 48.

(1-5. Paper Feeding Unit 5)

The paper feeding unit 5 feeds the recording medium 48 accommodated in a cassette 47 to the secondary transfer portion 46 via a feed roller 49 sequentially, as shown in FIG. 1. The toner image is transferred to the recording medium 48 fed to the secondary transfer portion 46, and the toner image transferred by the fixing unit 4 is fixed, and the recording medium 48 is thereafter carried out to a discharge tray 50.

(1-6. Cleaning Unit 6)

The cleaning unit 6 can come close to and away from the intermediate transfer belt 44, and recovers the toner staying in the intermediate transfer belt 44 so as to clean by coming close thereto.

(1-7. Control Unit 7)

Figure 4:
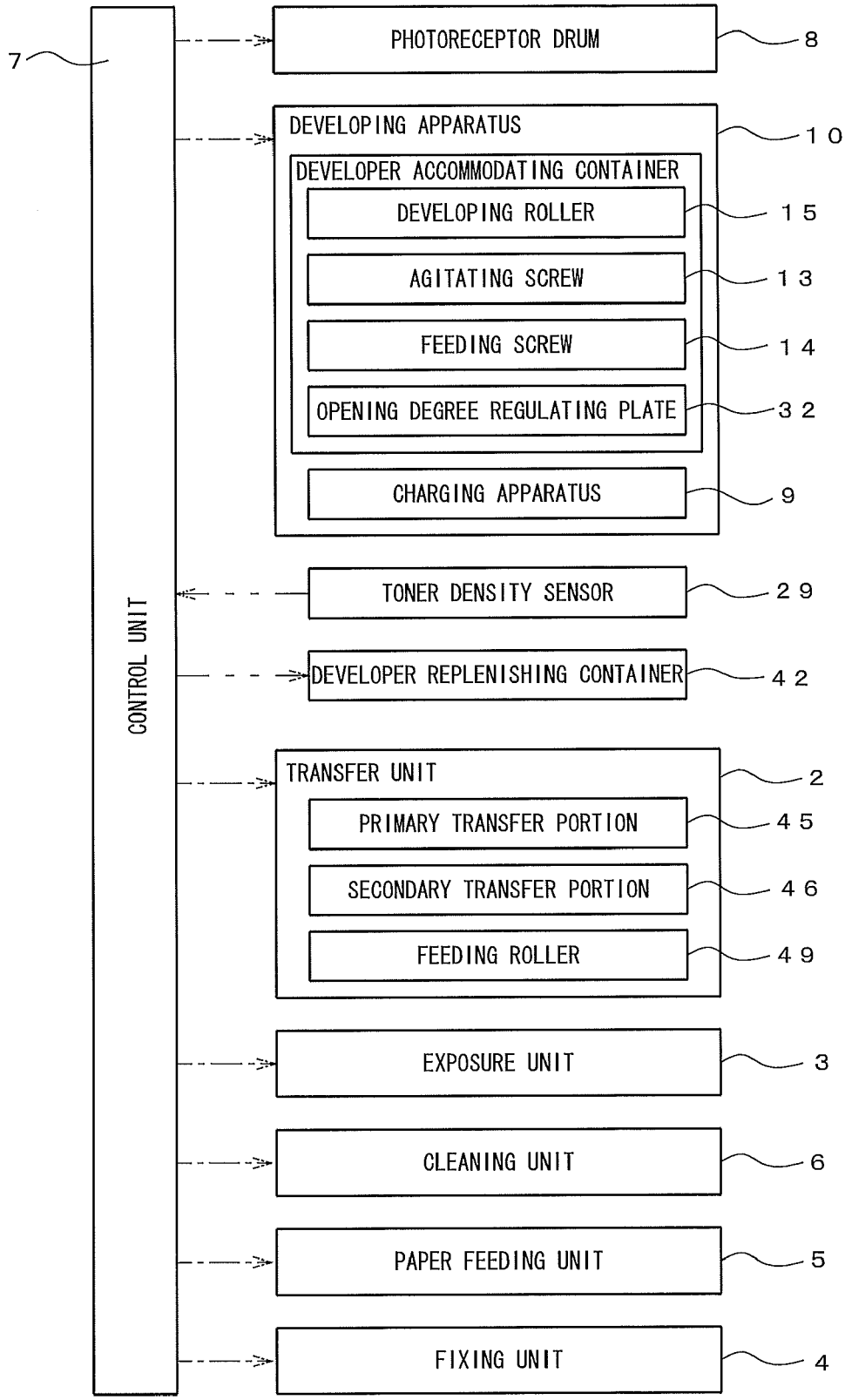
FIG. 4 is a block diagram of the image forming apparatus in accordance with the present embodiment.

The control unit 7 executes an image forming process on the basis of an input signal as shown in FIG. 4. In the image forming process, the agitating screw 13 and the feeding screw 14 are rotatably driven and the developer is circulated while being agitated, although details thereof will be mentioned below. In this process, the toner is fed to the photoreceptor drum 8 via the developing roller 15, and the new developer is appropriately replenished from the developer replenishing container 42 on the basis of the toner density within the developer accommodating container 12 detected by the toner density sensor 29. Further, the deteriorated developer is discharged from the developer accommodating container 12, by appropriately opening the opening degree regulating plate 32.

2. Whole Motion

Next, a description will be given of a motion of the image forming apparatus having the structure mentioned above.

At a time of forming the image, a color print data obtained by reading the image or an image data output from a personal computer or the like is applied to a predetermined signal process, and is thereafter transmitted as an image signal of each of the colors including yellow (Y), magenta (M), cyan (C) and black (Bk) to each of the image forming units 1.

In each of the image forming units 1, an image latent image is formed by projecting a laser light which is modulated by the image signal onto the photoreceptor drum 8. Further, the toner is fed to the photoreceptor drum 8 from the DEVELOPING APPARATUS 10.

In the DEVELOPING APPARATUS 10, a developing process is carried out in accordance with the following manner. In other words, the developer accommodated within the developer accommodating container 12 is circulated while being agitated, by rotatably driving the agitating screw 13 and the feeding screw 14. Further, the toner is fed from the feeding screw 14 to the developing roller 15, is scraped off by the regulating member 12*a* so as to be set to a fixed amount, and is thereafter fed to the photoreceptor drum 8. In this case, details of the developing process will be mentioned later.

Accordingly, the toner images of yellow, magenta, cyan and black are formed respectively on each of the photoreceptor drum 8. The formed toner images of yellow, magenta, cyan and black are sequentially overlapped on the moving intermediate transfer belt 44 so as to be primarily transferred. The overlapping toner image formed on the intermediate transfer belt 44 as mentioned above is moved to the secondary transfer portion 46 in accordance with a movement of the intermediate transfer belt 44.

Further, the recording medium 48 is fed from the paper feeding unit 5. The fed recording medium 48 is fed to a portion between the secondary transfer portion 46 and the intermediate transfer belt 44 by the feed roller 49, and the toner image formed in the intermediate transfer belt 44 is transferred thereto. The recording medium 48 to which the toner image is transferred is further fed to the fixing unit 4, where the transferred toner image is fixed, and is thereafter discharged to the discharge tray 50.

(2-1. Developing Process)

In the developing process, the developer accommodated within the developer accommodating container 12 is moved in a circulating manner while being agitated, by rotatably driving the agitating screw 13 and the feeding screw 14. In this process, the toner is fed to the developing roller 15 by the feeding screw 14.

In other words, in the second accommodating portion 21, the developer is fed from the first communication portion 22 side to the second communication portion 23 side while being agitated by the first blade portion 37 of the feeding screw 14, and is fed to the developing roller 15. If the developer runs into the vicinity of the second communication portion 23, the developer is exposed to a flow resistance by the inverse wound second blade portion 38. Accordingly, the developer mainly flows into the first accommodating portion 20 via the second communication portion 23. Further, a part of the developer (the surplus developer) gets over the second blade portion 38 so as to flow into the inflow regulation region 25. The third blade portion 39 is provided at a position getting over the second blade portion 38, and the developer is agitated and flows again in a forward direction. Further, the developer discharge port 31 is formed in the middle of the flowing region by this third blade portion 39. Accordingly, a feeding speed of the developer is not lowered in the vicinity of the developer discharge port 31, and an amount of the developer discharged via the developer discharge port 31 does not become more than necessary. The developer which is not discharged from the developer discharge port 31 flows into the first accommodating portion 20 via the third communication portion 24. In this case, the developer discharge port 31 is regulated its opening degree by the opening degree regulating plate 32 on the basis of a difference of developing process condition, as mentioned below.

In the first accommodating portion 20, a fact that the toner is consumed is detected by the toner density sensor 29, and the developer is appropriately replenished from the developer replenishing container 42 to the developer accommodating container 12 on the basis of the detection signal. The developer is replenished via the developer replenishing port 30 formed in the first accommodating portion 20. The developer replenishing port 30 is formed between the second communication portion 23 and the third communication portion 24, and is positioned in a downstream side of the third communication portion 24 with respect to a circulating and moving direction of the developer. Accordingly, the developer flows while being agitated together with the developer flowing via the third communication portion 24 without being discharged from the developer discharge port 31, and flows together with the developer circulating and moving via the second communication portion 23. Accordingly, it is possible to smoothly mix with reason the replenished new developer and the circulating and moving developer, and it is possible to inhibit a dispersion of the toner density from being generated. Further, the replenished developer does not run into the developer discharge port 31 as is different from the prior art.

(2-2. Opening Degree Control of Developer Discharge Port 31)

The opening and closing motion of the opening degree regulating plate 32 may be controlled, for example, in accordance with the following manner.

In other words, the opening degree of the developer discharge port 31 is regulated by presuming a weight of the developer within the developer accommodating container 12 on the basis of the detection signal by the toner density sensor 29, and deciding the open position by the opening degree regulating plate 32 on the basis of a difference of presumed amount of the developer.

(2-2-1. Presuming Method of Weight of Developer)

Figure 6:
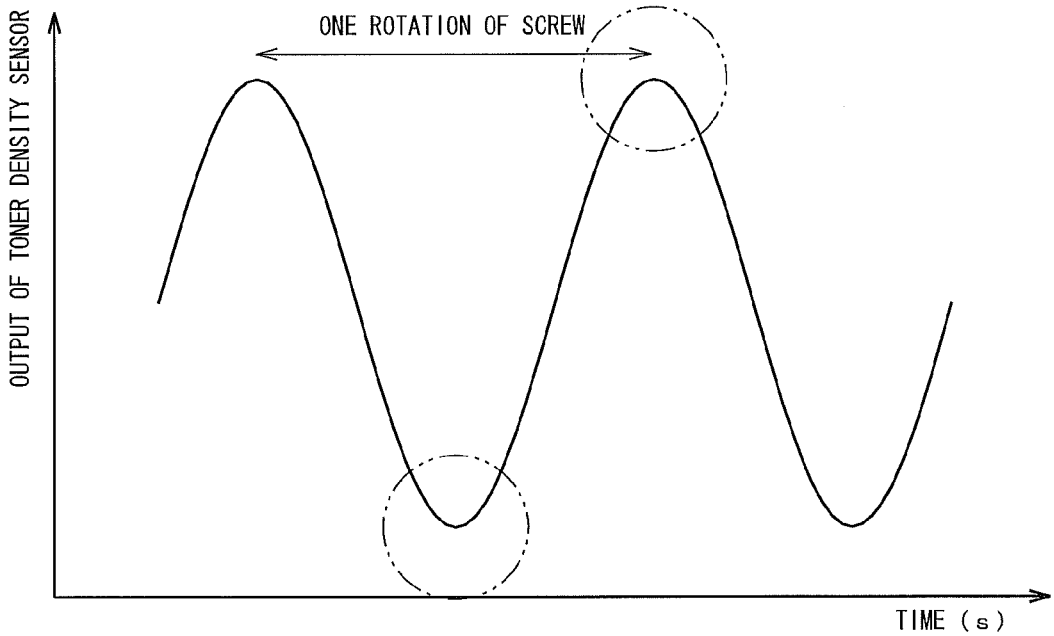
FIG. 6 is a graph showing a change of an output value of the toner density sensor in accordance with a rotation of an agitating screw.
Figure 7A:
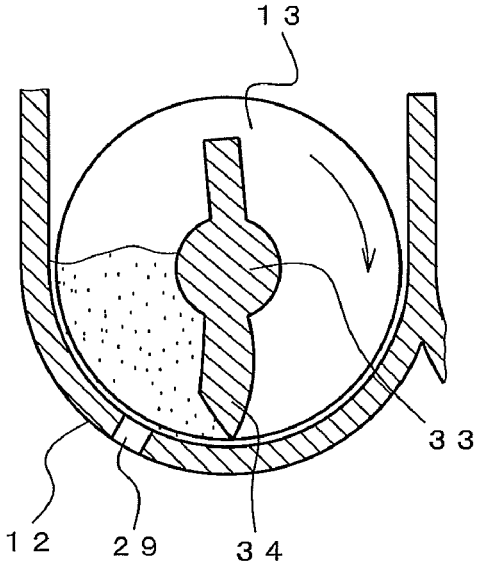
FIGS. 7A and 7B are transversal cross sectional views showing a state of a developer in accordance with the rotation of the agitating screw in the vicinity of the toner density sensor.
Figure 9:
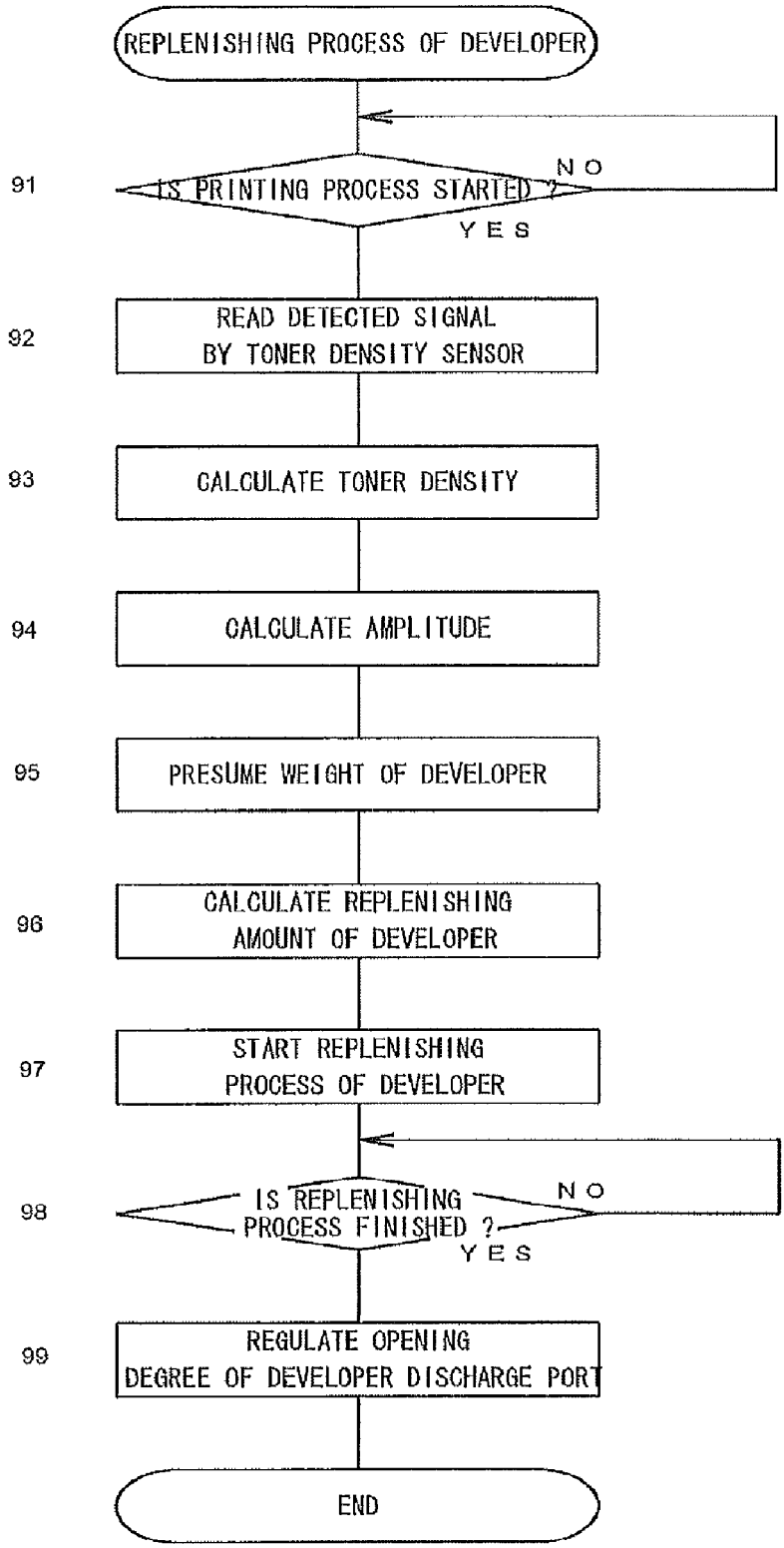
FIG. 9 is a flow chart showing a control content in the DEVELOPING APPARATUS in FIG. 1.

In the presumption of the amount of the developer within the developer accommodating container 12, as shown in FIG. 9, if a printing process is started (a step 91), the step reads the detection signal in the toner density sensor 29 while synchronously rotating the agitating screw 13 and the feeding screw 14 (a step 92). The read detection signal comes to a ripple wave form as shown in FIG. 6, on the basis of the rotation of the agitating screw 13. This is because a detected magnetic permeability periodically changes in accordance with a fluctuation of the weight of the developer within the detection range of the toner density sensor 29, as shown in FIG. 7, on the basis of the rotation of the agitating screw 13.

Figure 5:
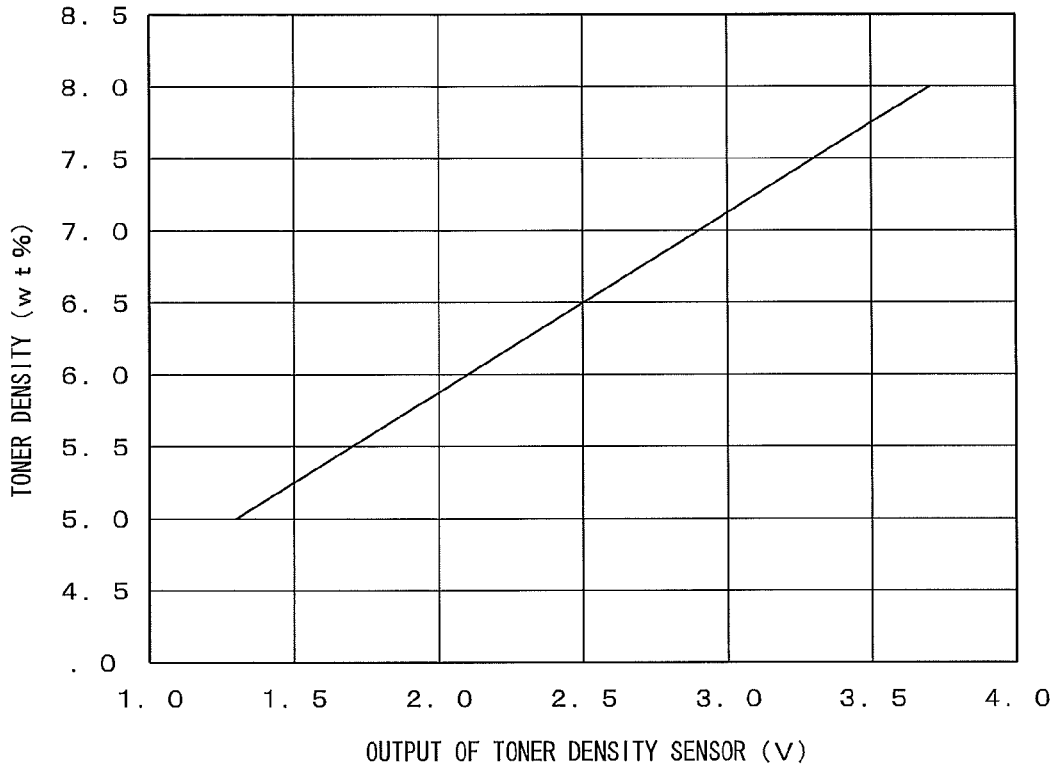
FIG. 5 is a graph showing a relationship between an output of a toner density sensor and a toner density.
Figure 7B:
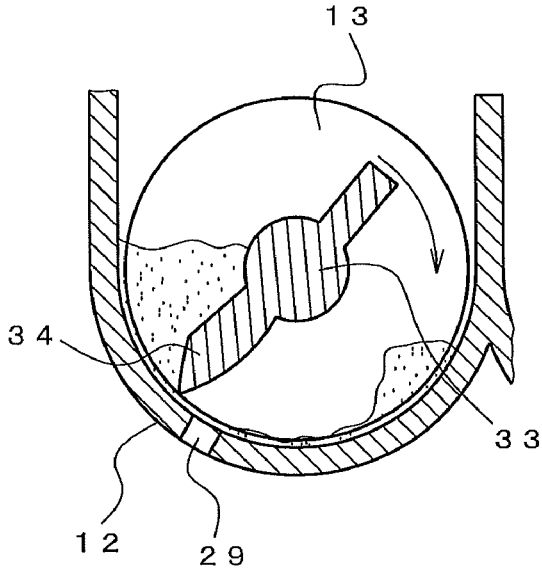

Accordingly, the step calculates the toner density in accordance with a graph in FIG. 5, on the basis of a detected value in a state shown in FIG. 7B in which the weight of the developer comes to a minimum value in the detection range (a step 93). Further, the step calculates an amplitude (a maximum amplitude) of the signal wave form from a detected value in a state shown in FIG. 7A in which the weight of the developer comes to a maximum value in the detected range, and the detected value in the state shown in FIG. 7B in which the weight of the developer comes to the minimum value in the detection range, on the basis of the detected signal in the toner density sensor 29 (a step 94).

Subsequently, the step presumes the weight of the developer in accordance with a data table shown in FIG. 8, on the basis of the calculated amplitude, and the toner density detected by the toner density sensor 29 (a step 95). In other words, it is determined that the smaller the amplitude becomes, the more the weight of the developer is. This is because it is thought that if the weight of the developer within the developer accommodating container 12 is more, the weight of the developer does not change so much within the detection region of the toner density sensor 29, and the magnetic permeability does not fluctuate so much even by rotating the agitating screw 13. Further, it is determined that the more the amplitude becomes, the less the weight of the developer is. This is because it is thought that if the weight of the developer within the developer accommodating container 12 is less, the weight of the developer within the detection range is apt to change, and the magnetic permeability greatly fluctuates, on the basis of the rotation of the agitating screw 13. Further, it is determined that the lower the toner density is, the more the weight of the developer is. This is because if the weight of the developer within the developer accommodating container 12 is much, the carrier included in the developer is apt to get together in the detection range of the toner density sensor 29, and the toner density within the detection range becomes relatively lower. Further, it is determined that the higher the toner density is, the less the weight of the developer is. This is because it is thought that if the weight of the developer within the developer accommodating container 12 is less, the developer is sufficiently agitated, and the toner density becomes relatively higher. In this case, in FIG. 8, the weight of the developer is segmented into five stages in such a manner that the weight becomes more in the order of weight small 2, weight small 1, reasonable, weight large 1 and weight large 2.

Further, the step calculates a replenishing amount of the developer on the basis of a difference between the detected toner density by the toner density sensor 29 and a previously stored target toner density (a step 96). Further, the step starts a replenishing process for replenishing the calculated replenishing amount of developer from the developer replenishing container 42 (a step 97).

(2-2-2. Regulating Method of Discharge Amount)

Thereafter, if the replenishing process is finished (a step 98), the step regulates the opening degree of the developer discharge port 31 by controlling to drive the opening degree regulating plate 32 in correspondence to a level of the presumed weight of the developer (a step 99). In this case, since the weight of the developer is presumed by five stages, the opening degree is structured such as to be regulated by five stages including a case that the developer discharge port 31 is fully opened by the opening degree regulating plate 32, and a case that it is fully closed.

In the meantime, even if the opening degree of the developer discharge port 31 becomes small (is closed in some cases), the developer smoothly flows from the second accommodating portion 21 to the first accommodating portion 20 via the third communication portion 24. Therefore, since there is no case that the unreasonable load is applied to the feeding screw 14 and the driving torque is increased, no damage is generated.

3. Other Embodiment

In this case, the present invention is not limited to the structure described in the embodiment mentioned above, but can be variously modified.

For example, in the embodiment mentioned above, the developer replenishing port 30 is structured such as to be arranged between the second communication portion 23 and the third communication portion 24, however, may be arranged at any position as far as a position within the first accommodating portion 20. In some cases, the developer replenishing port 30 may be arranged in an upstream side (between the first communication portion 22 and the second communication portion 23) of the second accommodating portion 21. In this case, it is possible to make the mixed state of the developer good so as to prevent a dispersion of the toner density from being generated, as mentioned above, by arranging the developer replenishing port 30 between the second communication portion 23 and the third communication portion 24.

Further, the embodiment mentioned above is structured such that the opening degree of the developer discharge port 31 is regulated by the opening degree regulating plate 32, however, the other structure such as a lens diaphragm may be employed.

Further, in the embodiment mentioned above, the feeding screw 14 is structured such that the first blade portion 37, the second blade portion 38 and the third blade portion 39 are formed in the feeding side rotating shaft 35, however, they may be independently driven, or the first blade portion 37 may be driven independently from the second blade portion 38 and the third blade portion 39. In this case, it is possible to regulate an inflow amount of the developer into the inflow regulation region 25 regardless of a feeding capacity of the developer by the first blade portion 37, by controlling the rotating speed of the second blade portion 38 (in some cases, the opening degree regulating plate 32 may be unnecessary).

Further, in the embodiment mentioned above, the weight of the developer within the developer accommodating container 12 is presumed on the basis of the amplitude of the signal wave form input from the toner density sensor 29 and the toner density, however, may be presumed in the following manner.

For example, the weight of the developer within the developer accommodating container 12 may be presumed in accordance with a data table in FIG. 10, on the basis of a fluctuation ratio of a cycle of the signal wave form input from the toner density sensor 29, and the toner density. In other words, if the weight of the developer within the developer accommodating container 12 is increased, the load applied to the agitating screw 13 becomes large, and the rotating speed is lowered. Accordingly, the cycle of the signal wave form output from the toner density sensor 29 becomes longer (the fluctuation ratio becomes larger (becomes plus)). On the other hand, if the weight of the developer within the developer accommodating container 12 is reduced, the load applied to the agitating screw 13 becomes small, and the rotating speed is increased. Therefore, the cycle of the signal wave form output from the toner density sensor 29 becomes shorter (the fluctuation ratio becomes smaller (becomes minus)). Accordingly, the weight of the developer within the developer accommodating container 12 may be presumed in accordance with the data table in FIG. 10, on the basis of the fluctuation ratio of the cycle of the signal wave form, and the detected toner density.

Further, the structure may be made such that a pressure sensor (not shown) is provided in addition to the toner density sensor 29, a pressure directly applied from the developer within the developer accommodating container 12 is detected by the pressure sensor, and the weight of the developer within the developer accommodating container 12 is presumed in accordance with a data table in FIG. 11, on the basis of a result of detection.

Further, each of the embodiments mentioned above is structured such that the weight of the developer is presumed on the basis of the amplitude or the cycle of the signal wave form input from the toner density sensor 29, and the toner density, however, the weight of the developer may be presumed only from the amplitude of the signal wave form, only from the cycle or only from the pressure, although a precision is somewhat low.

What is claimed is:

1. A developing apparatus comprising:

a developer carrying member;

a developer accommodating container extending from one end to the other end along said developer carrying member, and in which developer is accommodated;

a first feeding member provided within said developer accommodating container and feeding the accommodated developer while agitating; and a second feeding member provided within said developer accommodating container and feeding the developer to said developer carrying member, wherein said developer accommodating container comprises:

a first accommodating portion in which said first feeding member is arranged;

a second accommodating portion in which said second feeding member is arranged;

a first communication portion communicating said first accommodating portion and said second accommodating portion in one end side;

a second communication portion and a third communication portion communicating said first accommodating portion and said second accommodating portion at two positions in the other end side so as to be shifted their positions in a feeding direction of the developer;

a discharge portion arranged between the second communication portion and the third communication portion in said second accommodating portion, and provided for discharging the developer; and a replenishing portion arranged in a downstream side in the feeding direction of the developer than the third communication portion, in said first accommodating portion, and provided for replenishing the developer.

2. The developing apparatus as claimed in claim 1, wherein said replenishing portion is arranged between the second communication portion and the third communication portion.

3. The developing apparatus as claimed in claim 2, wherein a conveyance inhibiting portion preventing the conveyance of the developer is provided in the vicinity of an upstream side in a feeding direction of the developer, with respect to said discharge portion.

4. The developing apparatus as claimed in claim 2, wherein an opening degree regulating member for regulating an opening degree of said discharge portion is provided.

5. The developing apparatus as claimed in claim 2, wherein the developing apparatus further comprises:

a developer weight presuming member for presuming a weight of the developer within said developer accommodating container; and an opening degree controller regulating an opening degree of the discharge portion by controlling to drive an opening degree regulating member on the basis of the weight of the developer which is presumed by said developer weight presuming member.

6. An image forming apparatus comprising the developing apparatus as claimed in claim 2.

7. The developing apparatus as claimed in claim 1, wherein a conveyance inhibiting portion preventing the conveyance of the developer is provided in the vicinity of an upstream side in a feeding direction of the developer, with respect to said discharge portion.

8. An image forming apparatus comprising the developing apparatus as claimed in claim 7.

9. The developing apparatus as claimed in claim 1, wherein an opening degree regulating member for regulating an opening degree of said discharge portion is provided.

10. An image forming apparatus comprising the developing apparatus as claimed in claim 9.

11. The developing apparatus as claimed in claim 1, wherein the developing apparatus further comprises:

a developer weight presuming member for presuming a weight of the developer within said developer accommodating container; and an opening degree controller regulating an opening degree of the discharge portion by controlling to drive an opening degree regulating member on the basis of the weight of the developer which is presumed by said developer weight presuming member.

12. An image forming apparatus comprising the developing apparatus as claimed in claim 11.

13. An image forming apparatus comprising the developing apparatus as claimed in claim 1.

14. The developing apparatus as claimed in claim 1, wherein the replenishing portion replenishes the developer directly to the first accommodating portion.

15. The developing apparatus as claimed in claim 1, further comprising a partition arranged between the first accommodating portion and the second accommodating portion, wherein the discharge portion and the replenishing portion are arranged on opposing sides of the partition.

16. The developing apparatus as claimed in claim 15, wherein the third communication portion communicates toner past the partition from the second accommodating portion to the first accommodating portion.

17. The developing apparatus as claimed in claim 15, wherein the partition, the discharge portion and the replenishing portion are arranged between the second communication portion and the third communication portion.

18. A developing apparatus comprising:

a developer carrying member;

a container extending along the developer carrying member and housing the developer, the container including a first accommodating portion, a second accommodating portion, and opposing interior walls;

a first feeding member housed within the first accommodating portion and feeding the developer while agitating the developer;

a second feeding member housed within the second accommodating portion and feeding the developer to the developer carrying member;

a first partition positioned between the first accommodating portion and the second accommodating portion;

a second partition positioned between the first accommodating portion and a second accommodating portion, the second partition being spaced apart from the first partition;

a first pathway positioned between the first partition and one of the opposing interior walls of the container that communicates developer from the first accommodating portion to the second accommodating portion;

a second pathway positioned between the first partition and the second partition that communicates developer from the second accommodating portion to the first accommodating portion;

a third pathway positioned between the second partition and an other of the opposing interior walls of the container that communicates developer from the second accommodating portion to the first accommodating portion;

an outlet positioned within the second accommodating portion to discharge the developer from the second accommodating portion, the outlet being positioned between the second pathway and the third pathway; and an inlet positioned within the first accommodating portion to supply additional developer directly to the first accommodating portion.

19. The developing apparatus of claim 18, wherein the inlet is offset from the third pathway.

* * * * *